US009623274B2

(12) United States Patent
Holt, IV et al.

(10) Patent No.: US 9,623,274 B2
(45) Date of Patent: Apr. 18, 2017

(54) FUNCTIONAL TRAINING DEVICE

(71) Applicant: Mobius Enterprises, LLC, Tulsa, OK (US)

(72) Inventors: John Holt, IV, Collinsville, OK (US); Garry E. Anderson, Tulsa, OK (US); Brenton Robinson, Dallas, TX (US)

(73) Assignee: Mobius Enterprises, LLC, Tulsa, OK (US)

( * ) Notice: Subject to any disclaimer, the term of this patent is extended or adjusted under 35 U.S.C. 154(b) by 38 days.

(21) Appl. No.: 14/821,069

(22) Filed: Aug. 7, 2015

(65) Prior Publication Data

US 2016/0008652 A1 Jan. 14, 2016

Related U.S. Application Data

(63) Continuation of application No. 13/794,236, filed on Mar. 11, 2013, now abandoned.

(51) Int. Cl.

| | |
|---|---|
| ***A63B 21/22*** | (2006.01) |
| ***A63B 21/00*** | (2006.01) |
| ***A63B 21/06*** | (2006.01) |
| ***A63B 23/16*** | (2006.01) |
| ***A63B 21/075*** | (2006.01) |
| ***A63B 21/072*** | (2006.01) |

(Continued)

(52) U.S. Cl.

CPC ..... *A63B 21/0602* (2013.01); *A63B 21/072* (2013.01); *A63B 21/075* (2013.01); *A63B 21/4035* (2015.10); *A63B 21/4043* (2015.10); *A63B 21/06* (2013.01); *A63B 21/0601* (2013.01); *A63B 21/0603* (2013.01); *A63B 21/0608* (2013.01); *A63B 69/0053* (2013.01); *A63B 2071/0694* (2013.01)

(58) Field of Classification Search

CPC . A63B 21/06; A63B 21/0601; A63B 21/0602; A63B 21/0603; A63B 21/0604; A63B 21/0606; A63B 21/0607; A63B 21/0608; A63B 21/0618; A63B 21/075

USPC ..... 482/44–50, 92–113; 215/6, 396

See application file for complete search history.

(56) References Cited

U.S. PATENT DOCUMENTS 2,753,990 A * 7/1956 Chalfin ..... B65D 1/04 206/221

3,334,899 A 8/1967 Bosko (Continued)

*Primary Examiner* — Joshua Lee

(74) *Attorney, Agent, or Firm* — Keith E. Taber

(57) ABSTRACT

A versatile, functional training device of substantially elliptical shape and comprising a fluid weight that employs principles of unstable resistance as a means of increasing balance, stability, overall strength, core strength and proprioception while increasing lean muscle mass and burning calories. During operation, a user moves the device through a regimen of individualized movements, and the fluid weight moves and shifts inside the device, creating a instability at a point of resistance. The device comprises D-shaped handles with finger grooves adapted for maneuverability. The handles also may be filled with fluid to increase the weight and adaptability of the device across multiple activities and physical regimens. Measuring scales are provided on the device to measure the amount of fluid added to or removed from the device. The device may be transparent or translucent, and the fluid weight may be tinted to aid in visibility.

15 Claims, 7 Drawing Sheets

(51) Int. Cl.
*A63B 69/00* (2006.01)
*A63B 71/06* (2006.01)

(56) References Cited

U.S. PATENT DOCUMENTS 4,079,932 A * 3/1978 Schuetz ..... A63B 5/20 215/385
4,222,560 A * 9/1980 Hallerman ..... A63B 23/16 273/DIG. 4
4,720,098 A * 1/1988 Gordon ..... A63B 21/0602 206/315.1
4,773,640 A * 9/1988 Kolbel ..... A63B 21/0602 482/108
4,854,575 A * 8/1989 Wilson ..... A63B 21/0602 482/108
5,207,338 A * 5/1993 Sandhu ..... A61J 9/00 215/11.1
5,242,348 A * 9/1993 Bates ..... A63B 21/0004 482/105
5,431,615 A * 7/1995 Correll ..... A63B 21/0602 446/267
5,433,438 A 7/1995 Gilman
5,445,587 A * 8/1995 Brown ..... A63B 21/0602 482/108
5,580,343 A * 12/1996 Cafiero ..... A47J 45/078 215/396
5,735,776 A 4/1998 Swezey et al.
5,857,946 A * 1/1999 Brown ..... A63B 21/0602 482/105
6,149,555 A * 11/2000 Kinback ..... A63B 21/0603 383/10
6,190,292 B1 2/2001 Panes
6,547,703 B1 4/2003 Swezey et al.
6,964,635 B2 11/2005 Wang
7,141,012 B2 * 11/2006 Lin ..... A63B 21/0004 482/121
7,993,250 B2 8/2011 Abbott
8,911,334 B1 * 12/2014 Cotter ..... A63B 43/02 482/105
2004/0082445 A1 * 4/2004 Zabel ..... A63B 21/06 482/109
2005/0137063 A1 * 6/2005 Abdo ..... A63B 21/0004 482/105
2010/0248910 A1 9/2010 DiLuglio
2011/0160024 A1 6/2011 Candela et al.
2011/0275494 A1 11/2011 Radi et al.
2013/0267390 A1 * 10/2013 Warren ..... A63B 21/0602 482/93
2013/0337980 A1 * 12/2013 Himmelrick ..... A63B 21/072 482/108

* cited by examiner

FUNCTIONAL TRAINING DEVICE

TECHNICAL FIELD OF THE INVENTION

The present invention relates generally to functional fitness training devices and, more particularly, to fitness devices that focus on the principal of unstable resistance as a means of increasing balance, stability, overall strength, core strength and proprioception while increasing lean muscle mass and burning calories. A method of improving proprioception and physical health also is provided.

SUMMARY OF THE INVENTION

The present invention is directed to a functional fitness device comprising a substantially elliptical body and a port associated with the body for receiving a fluid weight inside the body, wherein the fluid weight inside the body is unstable and creates instability at the point of resistance during multi-planar movements and increases the functionality of the device.

The present invention further is directed to a method of improving proprioception and physical health. The method comprises the step of utilizing the instability of weight as a form of unstable resistance during multi-planar functional movements and moving a substantially elliptically-shaped device holding unstable weight through multi-planar functional movements.

The present invention further is directed to a functional fitness device comprising a substantially elliptical elastomeric body and a port associated with the body for receiving fluid weight inside the body. The weight inside the body is unstable and creates instability at the point resistance of a user. The device further comprises at least one handle associated with the body, wherein the at least handle comprises at least one chamber and at least one port for receiving fluid weight inside the handle.

The invention further is directed to a functional fitness device comprising a substantially elliptical elastomeric body and a port for receiving fluid weight inside the body. The weight inside the body is unstable and creates instability at the point of resistance of a user. The device further comprises at least one handle associated with the body, wherein the at least one handle comprises a port for receiving fluid weight inside the handle and a graduated scale for measuring the amount of fluid weight inside the body.

DETAILED DESCRIPTION OF THE INVENTION

Figure 1:
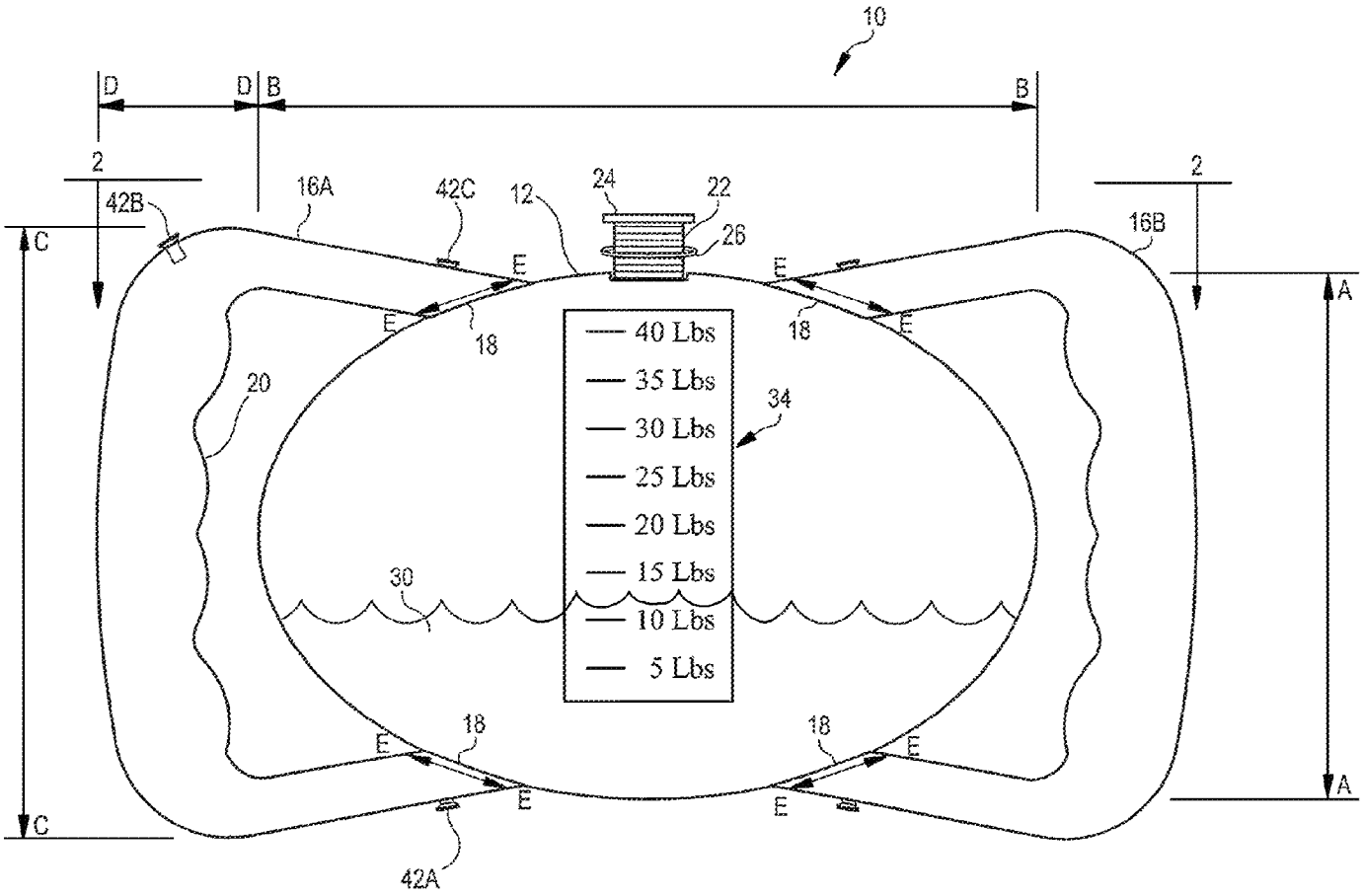
FIG. 1 is a plan view of an exemplary functional training device of the present invention.

Functional training is an approach to health and fitness achieved through training the body for targeted activities and tasks. These tasks may be necessary activities performed in daily life or focused activities for improving skill and agility in a particular sport. Unstable resistance training comprises an essential component of many functional training programs. Studies show that resistance exercises increase strength of both targeted muscle groups and overall musculature along the entire kinetic chain, which in turn increases efficiency and power of bodily movements. Functional training maximizes human performance in the context of daily activities and focuses on the characteristics that maximize performance, power, agility, proprioception, neuromuscular coordination, cardiovascular conditioning and athletic skill.

Although functional training applies across a broad spectrum of activities, it originates in physical rehabilitation. Physical therapists employ concepts of functional training in rehabilitating patients' bodies back to an ideal postural alignment in order to perform tasks that are restricted or prohibited by an injury or a life-changing accident. A physical therapist may work with a patient to perform exercises that mimic the movements or activities that the patient performed before the injury, such as strengthening the back to enable heavy lifting. Functional training uniquely adapts a regimen to meet the individualized needs of a patient, incorporating the principle of unstable resistance to improve the patient's physical functioning.

Functional training also is used in sports to help athletes improve balance, stability, overall and core strength and proprioception while improving lean muscle mass and burning calories to improve body composition. Functional training helps an athlete improve overall health and fitness and decrease the number of possible injuries sustained during performance. In fact, studies have shown that training with a variable load more closely imitates the human body's natural movements. The human body moves through sagittal, frontal and transverse planes in space while performing everyday activities or while engaged in a sporting activity. Functional training helps the body mimic natural functions performed in executing multi-planar movements and, therefore, retrains the human body to carry out motion patterns similar to natural movements.

Functional training differs from conventional, machine-based training in that it supplies variable resistance, which is very effective in improving balance, stability and coordination. Machine-based training offers only two-dimensional, static movement and is adapted to fit the natural body movements of only a small percentage of the population, basically individuals who are of average body height and build. Furthermore, conventional training techniques track joint function and load the musculature. This type of training compromises the safety of individuals outside the average range by forcing their bodies into movements inconsistent with their natural patterns and their own kinetic chain.

With the advent of functional training, however, various types of equipment have been created which are used in connection with regimens that track everyday movements to train the human body through the principle of unstable resistance. Early functional products focused on stability training and were based on the principle of postural instability. In other words, these products supply an unstable base upon which the user sits, stands or lies down. The instability created by these early functional training tools requires the user to employ muscle groups that counteract the instability, thus improving overall postural stability and increasing the strength and conditioning of the affected musculature.

Conventional functional training products based upon instability are cumbersome and impede the activities and movements through which a user can employ them. The shape and design of these conventional stability training devices limit the range of movement. For example, the size and shape of some conventional functional training equipment allows the device to be used for strength conditioning but not for physical therapy. Consequently, multiple pieces of equipment may be required to address the individualized needs of a particular user. This severely limits the applicability and versatility of conventional functional training devices since most of the physical challenges that humans face in life occur when performing tasks through multiplanar sagittal, frontal and transverse movements. The functional fitness device of the present invention replaces multiple pieces of equipment with the versatility to perform movements commonly performed with conventional functional devices, such dumbbells, kettle bells, medicine balls and tornado balls, while increasing maneuverability, safety, and structural integrity. All of these movements can be performed with just one device of the present invention.

Conventional functional training products contain structural weaknesses and experience very high failure rates, often at the handles. Some of these training devices cannot be slammed or thrown due to structural weaknesses that limit their applicability in certain types of training regimens. Additionally, the handles of these devices routinely fail when exposed to normal loads and movements. The functional training device of the present invention overcomes weaknesses in the handles and overall structure.

Conventional functional training devices also comprise a static weight and are of limited versatility. The present invention overcomes this limitation by allowing the user to vary the weight inside the device, both in the body of the device and in the handles. Variable weight permits the device to be used in a wide variety of activities, through a wider range of motions and by diverse groups of users who have differing body types and individualized physical needs.

The functional training device of the present invention is a unique, functional strength tool that fills a necessary facet of functional training that is currently lacking in availability to the general public. The present invention differs from conventional functional training tools in that it employs a variable weight inside the device and creates a point of unstable resistance when used in full range of motion exercises during full body workouts. The use of a fluid weight as a form of unstable resistance makes this possible. The device uses water or alternative fluid weight to create inertia during various strength and agility training drills. The fluid weight causes instability in the device and makes the user incorporate more muscle groups and neurological response than does a static weight, such as a dumbbell, kettlebell or barbell. This instability also increases core recruitment during virtually any range of motion, which is a highly desirable trait for anyone, ranging from the casual fitness enthusiast to the physical therapy patient to the professional athlete.

In addition to the above mentioned benefits, the functional training device of the present invention also improves balance and proprioceptive awareness. Balance enhances maximal strength by improving the ability of the body to compensate to maintain optimal alignment to the ground throughout the joints. It also is vital to preventing injuries caused by misaligned joints, such as a rolled ankle from an improper stride during a sprint. Proprioception is a full body awareness that allows one to properly utilize one's limbs without consciously looking at them. Improved proprioception leads to heightened full-body awareness and, therefore, more efficient use of the body with far less effort or conscious thought. The present invention enhances both of these attributes by forcing the user to compensate for unpredictable shifts caused by the fluid weight shifting rapidly inside the device during lifts and other multi-planar movements. These and other advantages of the present invention will be apparent from the following description of embodiments.

Turning now to the drawings in general, and to FIG. 1 in particular, there is shown therein an example of a functional fitness device 10 of the present invention. The device 10 comprises a substantially elliptical body 12. The body 12 may be any shape but preferably forms an ellipsoid or prolate spheroid, as these shapes permit a greater range of movement and allow versatility of the device in a variety of activities. For example, when a user moves the device 10 in a vertical position through a plane between the knees, an ellipsoid shape enables easier movement. As used herein, a substantially elliptical body means an ellipsoid, a prolate spheroid or other three-dimensional figure resembling a flattened sphere.

Although the body 12 can be of any desirable size, it generally ranges in size from about 5 inches to about 15 inches wide at the polar diameter, as shown by line A-A in FIG. 1. In one embodiment of the invention, the body 12 measures about 8 inches at the polar diameter. The body 12 ranges from about 5 inches to about 18 inches in diameter along the equatorial diameter, as shown by line B-B in FIG. 1. In one embodiment of the invention, the body 12 measures about 12 inches along the equatorial diameter. Body 12 is bladderless and is comprised of an elastomeric material selected from the group consisting of polyvinylchloride (PVC), neoprene, high density polyethylene (HDPE), rubber or hybrids of any of the foregoing.

The substantially elliptical shape of body 12 offers numerous benefits. For example, it will be appreciated that the elliptical shape of body 12 is ergonomic and facilitates bilateral movements during human use. Additionally, the substantially elliptical shape permits greater movement of fluid inside the body 12, in a manner yet to described, which in turn requires alteration of the manner in which a user handles the device 10 and requires greater physical compensation, exertion and body awareness to maintain posture during a physical regimen. To that end, the ratio of the polar diameter A-A to the equatorial diameter B-B of the body 12 ranges from about 1:1.5 to 2:3.5. In one embodiment of the invention, the ratio of the polar diameter A-A to the equatorial diameter B-B of the body 12 is about 2:3.

With continuing reference to FIG. 1, the body 12 of the device 10 comprises at least one handle 16A associated with the body. The handle 16A may be of any shape that enables the user to securely hold the device during a physical regimen but preferably does not extend a distance outside the surface of body 12 to a degree that interferes with ease of use. The handle 16A preferably forms a loop which extends from a location 18 on a side of the body 12 to a correlating location on an opposite side of the body. In one embodiment, the handle 16A may be reminiscent of a D-shape and comprises finger grooves 20. In another embodiment of the invention, the device 10 comprises more than one handle, 16A and 16B, to facilitate versatility of the device and ease of use.

Figure 2:
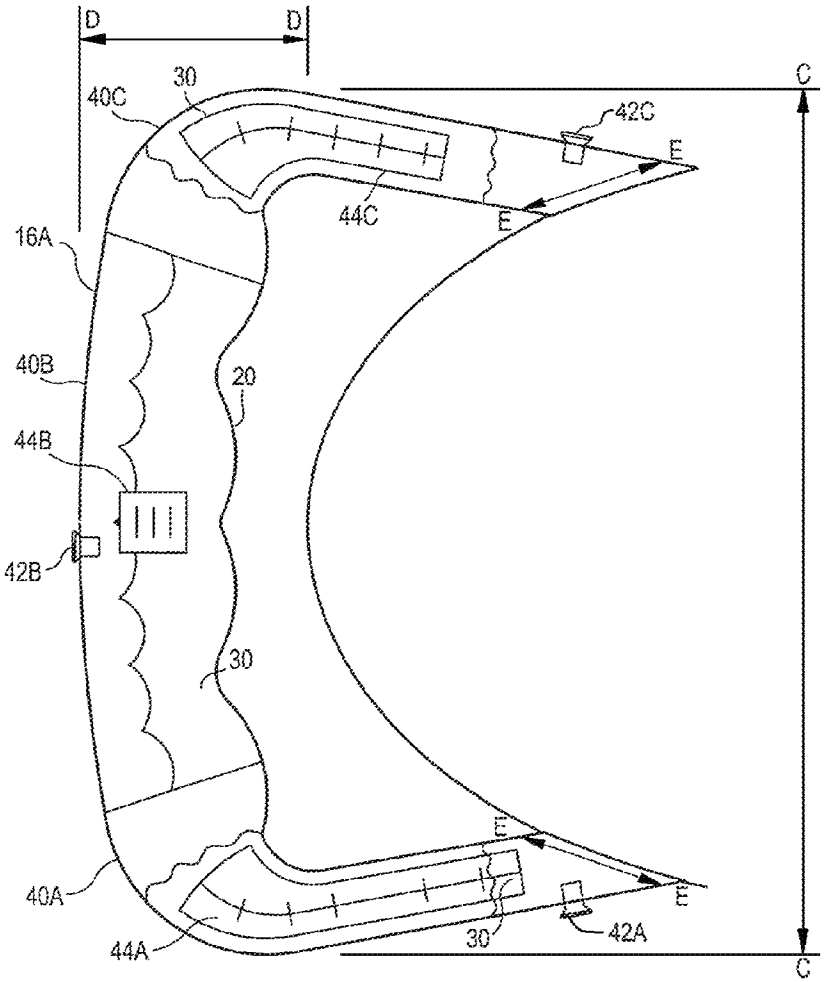
FIG. 2 is a plan view of the handle of an exemplary functional training device of the present invention.

Turning now to FIG. 2, in at least one embodiment of the invention, the size of handle 16A is at least about 5 to 20 inches wide as measured from outside edge to outside edge of the handle, as shown by line C-C. Handle 16A is at least about 3 to 6 inches tall as measured from the outermost exterior surface the body 12 to the upper exterior surface of the handle, as shown by line D-D. The width of the handle 16A is at least about 1 to 3 inches wide, and preferably at least about 1.5 inches wide, at the location 18 where the handle connects with body 12, as shown by line E-E, and leaves adequate space for the user's fingers. In one embodiment of the device 10, the overall width of handle 16 as measured along line C-C is about 5 inches wider than the polar diameter of the body 12.

The width of handle 16A may remain uniform throughout the entire length of the handle or may change in width at various points. For example, it may be advantageous to increase or decrease the width of the handle 16A at the location where the user holds the handle. Handle 16A preferably is integrally formed with the body 12 to increase structural integrity of the device 10. Although it may be desirable to form the handle 16A from a different material than the body 12, it is structurally advantageous to integrally form both the handle and the body from the same elastomeric material.

Returning to FIG. 1, body 12 further comprises a port 22 for receiving a fluid weight inside the body 12 or removing fluid weight from the body. As used herein, "fluid" and "fluid weight" mean any material that takes the shape of the container into which it is poured. The port 22 is positioned on the body 12 at an inconspicuous location so as not to interfere with the use of the device in full range of motion exercises. The port may be located at a side of the body 12 in between the one or more handles 16A and 16B. The port 22 is of sufficient size so that fluid weights may be received inside the body 12 of the functional training device 10. The port 22 comprises a cap 24 for sealing fluid weight in body 12 and may further comprise a neoprene washer 26 to stabilize and secure the cap and seal against fluid leakage.

The functional training device of the present invention 10 may be filled with a number of different fluid weights 30. The fluid weight 30 may be water, glycerin, metal shavings, sand, plastic beads, or hybrids of any of the foregoing. The fluid weight 30 that is selected for any application is subject to the individualized needs of the user and the particular activity for which the user intends to employ the device 10. The amount of fluid weight 30 inside the body 12 is variable and may range from at least about 0 to at least about 40 pounds. This weight variability feature, along with other features described herein, contributes to the versatility of the device 10 and enables serviceability across a broad range of uses and applications for a diverse array of users with individualized needs. For example, a recovering physical therapy patient may wish to fill the device with five pounds of fluid weight, whereas an athlete engaged in agility training may wish to fill the device with a forty pound weight.

Figure 3:
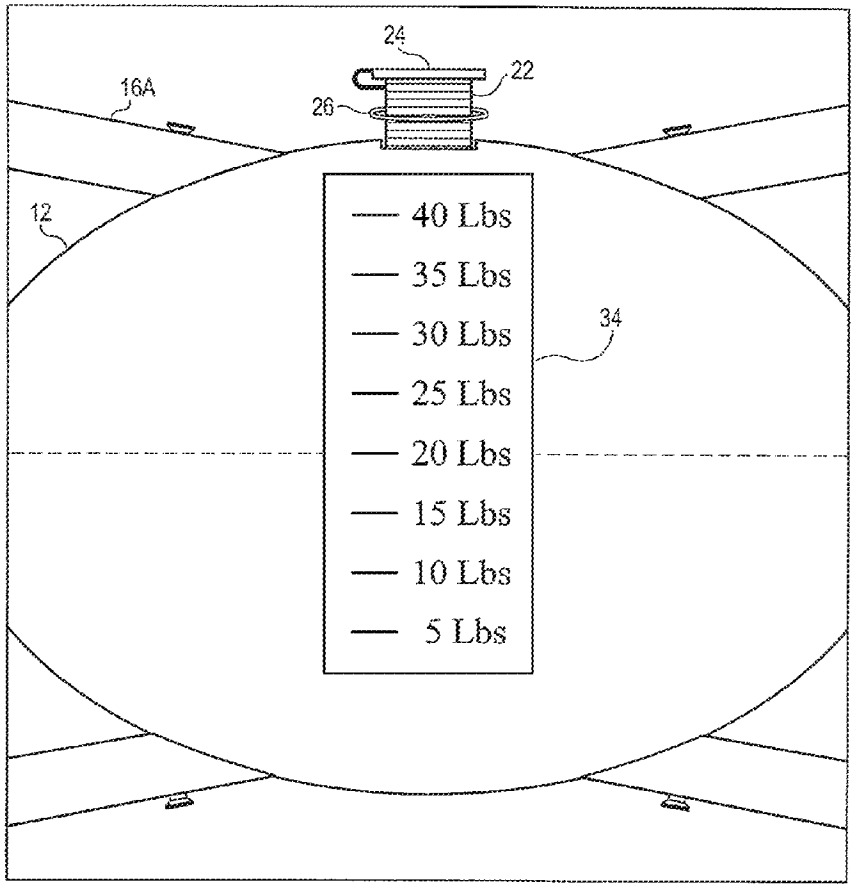
FIG. 3 is a plan view of the graduated scale of an exemplary functional training device of the present invention.

Turning now to FIG. 3, and with continuing reference to FIG. 1, the device 10 facilitates fluid weight measurement and may further comprise a graduated scale 34 associated with the body 12 for measuring the amount of fluid weight 30 received inside the body. The scale 34 will be adapted to the type of fluid weight 30 to be received inside the body. For example, since water has a particular density of 64 pounds per cubic foot, a scale that measures water weight at five pound increments may be displayed on the body 12 of the device 10. If sand, glycerin or metal shavings are to be used as fluid weight 30, an alternate scale, graduating in increments that correspond to the density of the respective fluid weight that is to be received inside the body 12, would be supplied. The graduated scale 34 may be engraved on the surface or inside the body 12 of the device 10. Alternately, interchangeably removable graduated scales may be supplied so that the user attaches to the body 12 the graduated weight scale that corresponds with the fluid weight 30 to be used for a particular application.

The body 12 may be translucent or transparent in order to visually aid the user in seeing and measuring the appropriate amount of fluid weight 30 received inside the device 10. In a further effort to facilitate measurement of the fluid weight 30, the device 10 may comprise a colorant for tinting the fluid weight in the body 12 and aiding visibility of the level of fluid weight inside the body. Additionally, the fluid weight 30 may be color coded to correspond with a particular weight. For example, a five pound weight may correspond to the color red, a ten point weight to the color green, and so forth. The colorant may be supplied in a separate container and added by the user to the fluid weight 30 in the body 12. Alternately, the inside of the body 12 may be coated with a stainless colorant that automatically tints the fluid weight 30 as it is added to the device 10 and makes contact with the inside of the body. It now will be appreciated that the ability to vary the fluid weight 30 inside the device 10, along with other features described herein, adapts the device across a wide variety of activities, through a wider range of motions and by diverse groups of users who have differing body types and individualized physical needs.

Figure 4:
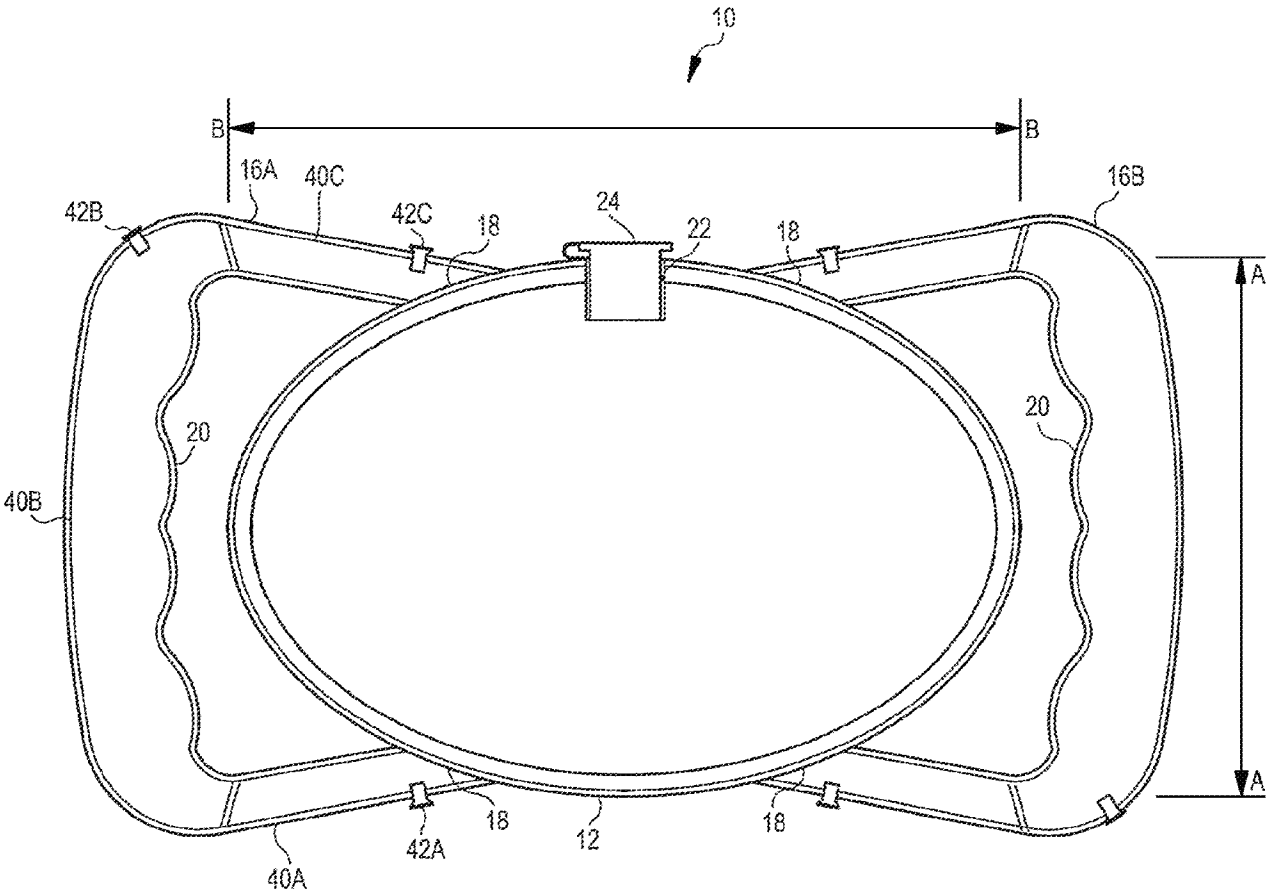
FIG. 4 is a sectional view of an exemplary functional training device taken along line 2-2 of FIG. 1.

Turning now to FIGS. 2 and 4, the handle 16A further may comprise one or more interior chambers 40A, 40B and 40C that are adapted to receive additional fluid weight 30 in the handle. The number of interior chambers 40 formed within handle 16A may vary depending how much additional weight is intended to be added to the particular device 10. As shown in cross-section in FIG. 4, each chamber 40A-40C is separated by a wall and integrally formed within the handle 16A of the body 12 of the device 10. Each chamber 40A, 40B and 40C further may comprise a port 42A, 42B and 42C for adding extra fluid weight 30 to the interior chambers 40A-40C of handle 16. The additional fluid weight 30 is added into the chambers 40A-40C through the ports 42A-42C in handle 16A. The additional total fluid weight 30 received inside the handle 16A can range from less than one pound to at least nine pounds. Preferably, the fluid weight 30 receivable inside each interior chamber 40A, 40B and 40C will be at least about 0.1 pound to 2 pounds. It will be appreciated that this feature allows extra weight to be added to the device 10 and, thereby, increases the available benefits of the device to a more diverse group of potential users without requiring a larger device or purchasing or using another fitness device or piece of equipment. It allows the same device 10 to be adapted to various activities and users, who will require variable sizes and weights for their individualized therapy or fitness training regimens. The handle 16A may further comprise one or more graduated scales 44A, 44B and 44C associated with each interior chamber 40A, 40B and 40C for measuring the amount of fluid weight 30 received inside each interior chamber.

Figure 5A:
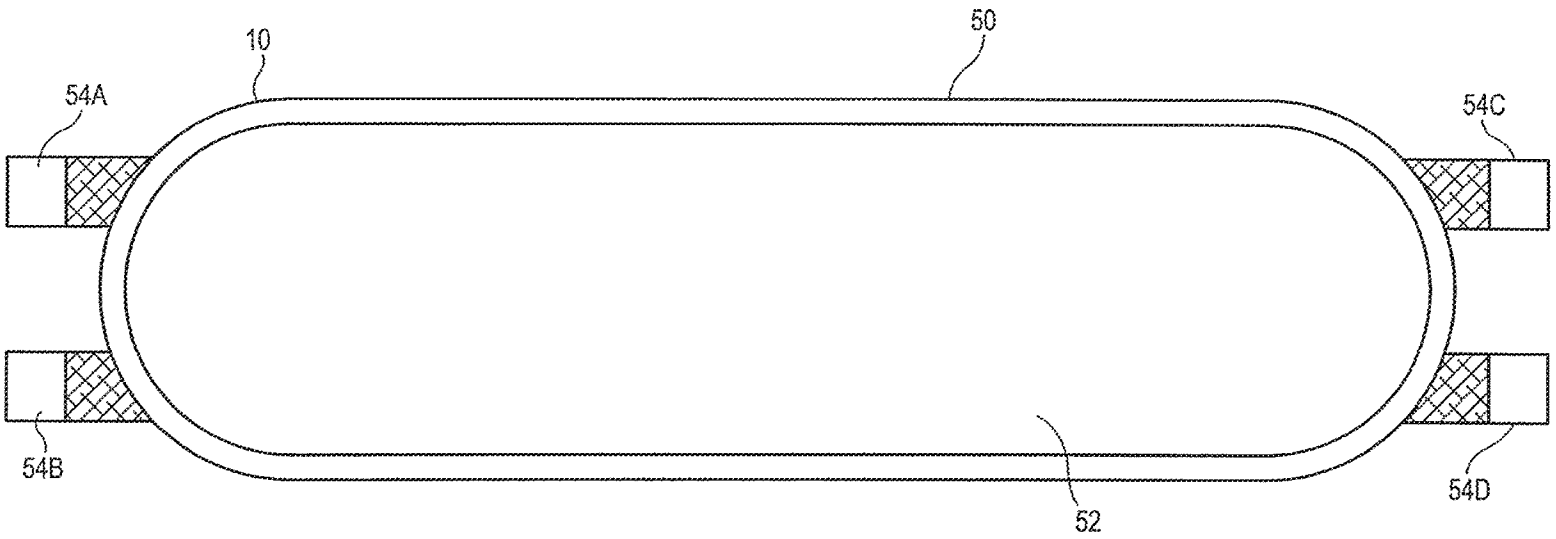
FIG. 5A is top view of an optional weight belt of an exemplary functional training device of the present invention.
Figure 5B:
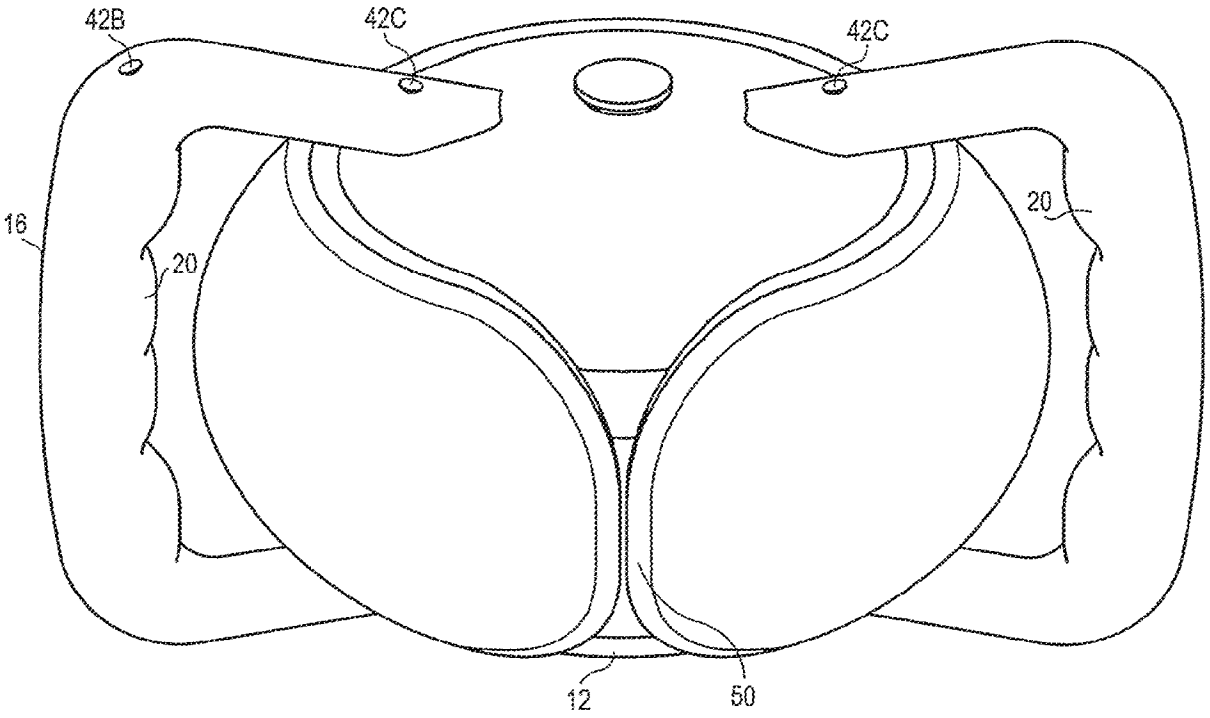
FIG. 5B is a perspective view showing the underside of the weight belt of FIG. 5A secured to the body of an exemplary functional training device of the present invention.
Figure 5C:
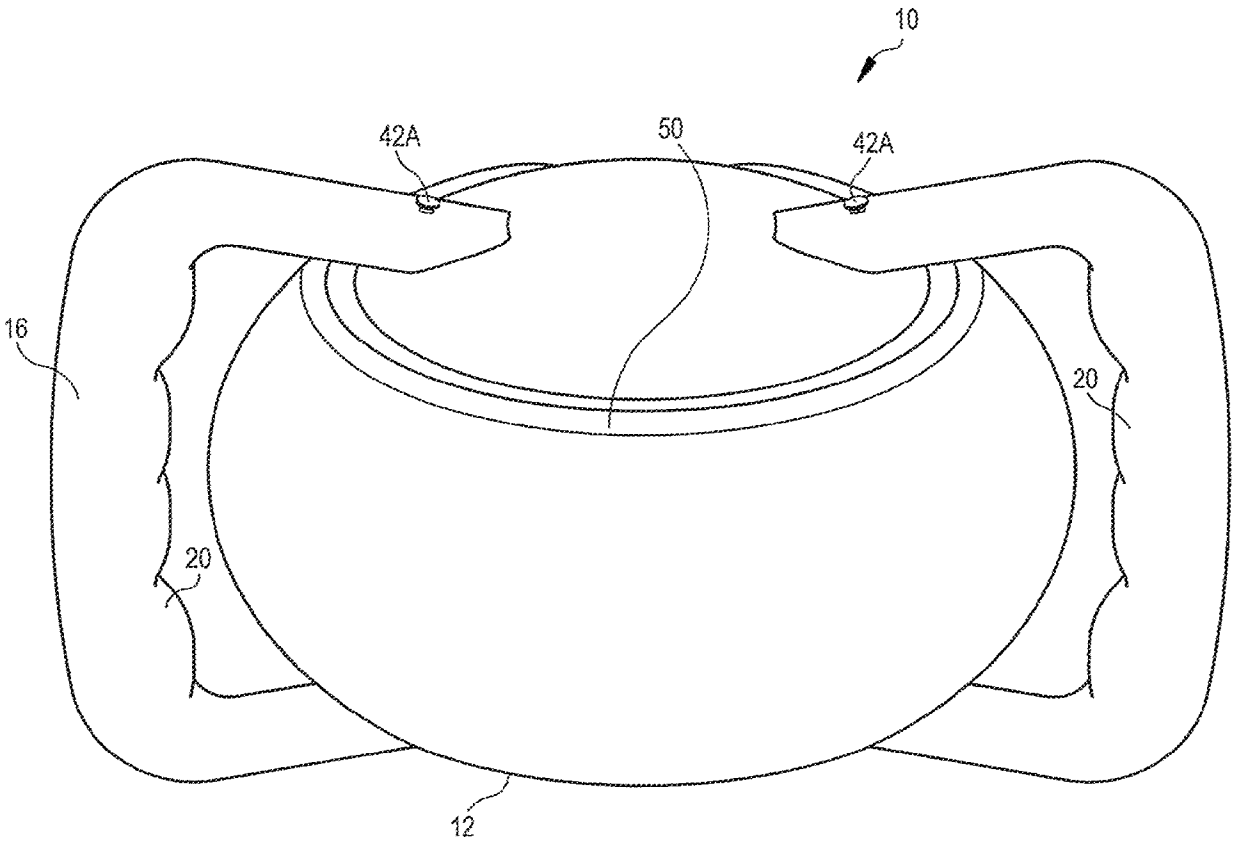
FIG. 5C is a perspective view showing the topside of the weight belt of FIG. 5A secured to the body of an exemplary functional training device of the present invention.

Turning now to FIG. 5, the device 10 of the present invention may further comprise a weight belt 50 that is removably attachable to the body 12 in a manner to be described. As shown in FIG. 5, the weight belt 50 has a central compartment 52 comprising sand or other weighted substance and is attachable to the device 10 by any suitable means, such as velcro straps 54A, 54B, 54C and 54D. The weight 50 has velcro straps 54A-D that are removably connectable to the device 10 and that wrap around the body 12 of the device. It may be advantageous to wrap the weight belt 50 longitudinally around the equatorial axis of the body 12, as shown in FIGS. 5B and 5C, to help secure the weight belt 50 to the device 10. The weight belt 50 adds additional weight from at least about 0.5 pounds to about 30 pounds. It will be appreciated that the weight belt 50 adds additional weight to the device 10 without detracting from its ease of use and while maintaining maneuverability and efficacy of the device through a variety of functional activities and movements.

The present invention also is directed to a method of improving proprioception and physical health. The method comprises the step of utilizing the instability of weight as a form of unstable resistance during multi-planar functional movements. Use of the device 10 now will be described. During operation, a user moves the device 10 having a substantially elliptical body through a regimen of individualized movements particularly designed and adapted to achieve the goals of the user. The fluid weight 30 moves inside the body 12 of device 10 and shifts during sagittal, frontal and transverse movements, thereby creating a point of instability at the point of resistance. As used herein, "point of instability" means the creation of an unstable physical environment for musculature during multi-planar movements. As used herein, "point of resistance" means maximum output for musculature. Conventional functional training products focus on instability at the point of resistance but cannot be slammed or used for dynamic exercises without tearing and leaking, and exercises with these types of devices are extremely limited. The substantially elliptical body of the present invention, along with other features heretofore described, dramatically increases maneuverability and makes it possible for smaller people, seniors, physical therapy patients or other special populations to use the device 10 in their own individualized functional training programs. Expanded range of uses with the present invention include group fitness, personal training, individual workout routines at home, strength conditioning, muscle conditioning, core conditioning, preventative injury training, water aerobics, physical therapy, pre- and post-operative physical therapy and general body awareness training.

It now will be appreciated that the present invention presents a unique form of instability at the point of resistance. This forces the user to fight against the unstable resistance created by the fluid weight inside the device and forces reaction based upon feel versus sight. This unique form of resistance helps the user increase proprioception, a very crucial yet overlooked skill in every day life and in sporting activity. Instead of placing the point of instability at the base of a piece of equipment, as with a workout bench, the device 10 of the present invention places the point of instability at the point of resistance. The majority of instability-based or functional training products that focus on instability as the point resistance are made in such a way that one uses them for certain activities or fitness goals but not others. The present invention replaces multiple pieces of equipment with the versatility to perform exercises commonly done with dumbbells, kettle bells, medicine balls, tornado balls, while increasing maneuverability, safety and structural integrity.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

The invention claimed is:

1. A functional fitness device comprising:

a substantially elliptical body having a polar diameter along a vertical axis and an equatorial diameter along a horizontal axis where the polar diameter is less than the equatorial diameter and the body is convex along both the vertical axis and the horizontal axis;

at least one handle that is centered on and perpendicular to the horizontal axis and comprising at least one interior chamber and a first port for receiving a fluid weight into the at least one interior chamber; and a second port associated with the body for receiving a fluid weight into the body that shifts within the body to create instability during movements of the body.

2. The functional fitness device of claim 1 wherein the fluid weight is selected from the group consisting of water, glycerin, metal shavings, plastic beads, sand and hybrids of any of the foregoing.

3. The functional fitness device of claim 1 wherein at least a portion of the body is partially transparent or translucent.

4. The functional fitness device of claim 3 further comprising a colorant for tinting the fluid weight in the body.

5. The functional fitness device of claim 3 further comprising a graduated scale associated with the body for indicating a weight of the fluid weight received inside the body.

6. The functional fitness device of claim 1 further comprising a graduated scale associated with the at least one interior chamber of the at least one handle for measuring an amount of fluid weight received inside the at least one interior chamber.

7. The functional fitness device of claim 1 wherein the body is bladderless and is comprised of an elastomeric material.

8. The functional fitness device of claim 7 wherein the elastomeric material is selected from the group consisting of PVC, neoprene, high density polyethylene, rubber and hybrids of the foregoing.

9. The functional fitness device of claim 1 wherein the at least one handle is integrally formed with the body and comprises a material selected from the group consisting of PVC, neoprene, high density polyethylene, rubber, and hybrids of the foregoing.

10. The functional fitness device of claim 1 further comprising a weight belt.

11. The functional fitness device of claim 1 wherein the ratio of the polar diameter to the equatorial diameter ranges from about 1:1.5 to about 2:3.5.

12. The functional fitness device of claim 1 wherein the at least one handle is two handles on opposite ends of the substantially elliptical body, each handle extending across the horizontal axis.

13. A method of improving proprioception and physical health, the method comprising the steps of:

providing a functional fitness device comprising:

a substantially elliptical body having a polar diameter along a vertical axis and an equatorial diameter along a horizontal axis where the polar diameter is less than the equatorial diameter and the body is convex along both the vertical axis and the horizontal axis;

at least one handle that is centered on and perpendicular to the horizontal axis and comprising at least one interior chamber and a first port for receiving a fluid weight into the at least one interior chamber; and a second port associated with the body for receiving a fluid weight into the body that shifts within the body to create instability during movements of the body; and moving the functional fitness device through multi-planar functional movements to create instability at a point of resistance during the multi-planar functional movements.

14. The method of claim 13 further comprising the step of adjusting a weight of the functional fitness device by adjusting an amount of fluid weight within the body.

15. The method of claim 13 wherein the multi-planar functional movements are employed in activities selected from the group consisting of physical therapy, preventative injury training, strength conditioning, muscle conditioning, water aerobics training, group fitness training and individual fitness training, pre- and post-operative physical therapy, core conditioning, and general body awareness training.

* * * * *